US005621447A

United States Patent [19]

Takizawa et al.

[11] Patent Number: 5,621,447

[45] Date of Patent: Apr. 15, 1997

[54] JET RECORDING METHOD

[75] Inventors: Yoshihisa Takizawa, Kawasaki; Katsuhiro Shirota, Inagi; Hisao Yaegashi, Kawasaki, all of Japan

[73] Assignee: Canon Kabushiki Kaisha, Tokyo, Japan

[21] Appl. No.: 469,994

[22] Filed: Jun. 6, 1995

Related U.S. Application Data

[63] Continuation-in-part of Ser. No. 964,837, Oct. 22, 1992, abandoned.

[30] Foreign Application Priority Data

Oct. 25, 1991 [JP] Japan ..... 3-279857
Oct. 25, 1991 [JP] Japan ..... 3-279870

[51] Int. Cl.[6] ..... B41J 2/205
[52] U.S. Cl. ..... 347/88; 347/99
[58] Field of Search ..... 347/99, 88

[56] References Cited

U.S. PATENT DOCUMENTS

| | | | |
|---|---|---|---|
| 4,361,843 | 11/1982 | Cooke et al. | 346/1.1 |
| 4,410,899 | 10/1983 | Haruta et al. | 346/140 R |
| 4,723,129 | 2/1988 | Endo et al. | 346/1.1 |
| 5,006,170 | 4/1991 | Schwarz et al. | 106/20 |
| 5,155,504 | 10/1992 | Oikawa | 346/140 R |
| 5,182,572 | 1/1993 | Merritt | 346/1.1 |
| 5,270,730 | 12/1993 | Yaegashi et al. | 346/1.1 |

FOREIGN PATENT DOCUMENTS

| | | |
|---|---|---|
| 54-161935 | 12/1979 | Japan . |
| 55-54368 | 4/1980 | Japan . |
| 58-108271 | 6/1983 | Japan . |
| 61-83268 | 4/1986 | Japan . |
| 61-159470 | 7/1986 | Japan . |
| 61-185455 | 8/1986 | Japan . |
| 61-197246 | 9/1986 | Japan . |
| 61-249768 | 11/1986 | Japan . |
| 62-48774 | 3/1987 | Japan . |
| 1242672 | 9/1989 | Japan . |
| 2-51570 | 2/1990 | Japan . |

*Primary Examiner*—Valerie Lund
*Attorney, Agent, or Firm*—Fitzpatrick, Cella, Harper & Scinto

[57] ABSTRACT

In a jet recording method, a normally solid recording material is placed in a heat-melted state in a path defined by a nozzle leading to an ejection outlet and, in a recording step, is imparted with a thermal energy corresponding to a recording signal to generate a bubble, thus ejecting a droplet of the recording material out of the ejection outlet. As an improvement, in the recording step, the bubble is caused to communicate with ambience, and the droplet is ejected in a diameter d (μm) and at an average speed v (m/sec) satisfying: $10 \leqq d \leqq 60$ and $7 \leqq v \leqq 20$. As a result, the droplet is deposited on a recording medium without pileup or scattering.

10 Claims, 11 Drawing Sheets

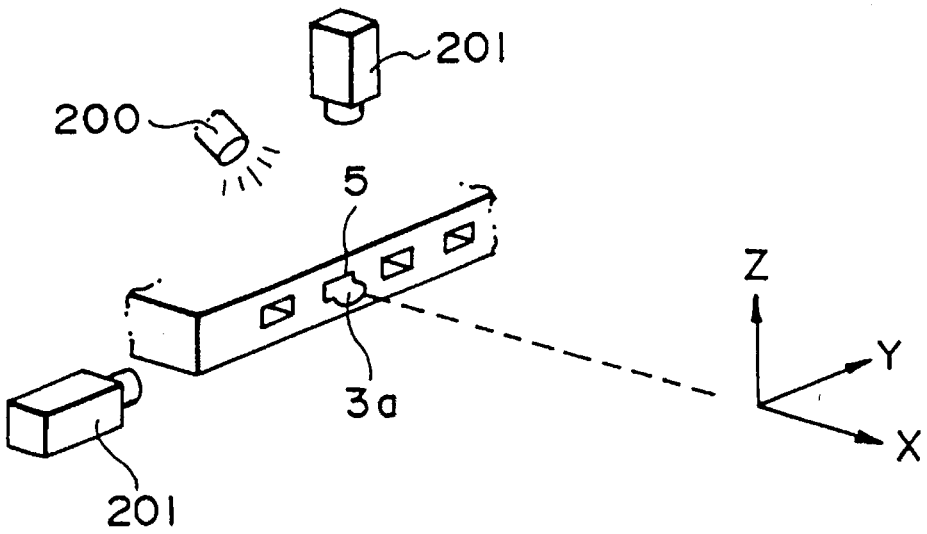
FIG. 7
FIG. 8(a)
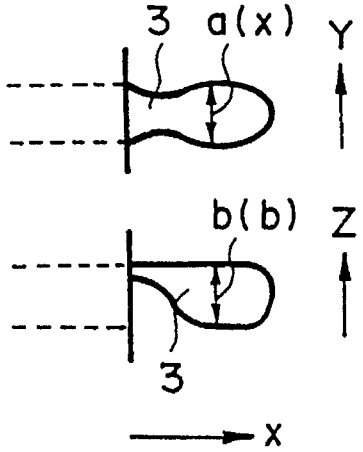
FIG. 8(b)
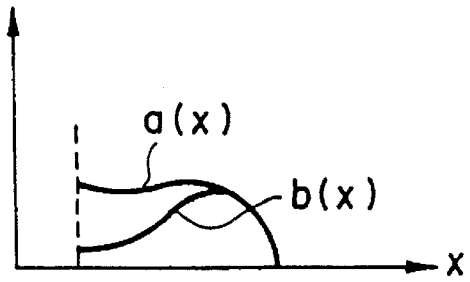
FIG. 8(c)

JET RECORDING METHOD

This application is a continuation of application Ser. No. 07/964,837 filed Oct. 22, 1992, now abandoned.

FIELD OF THE INVENTION AND RELATED ART

The present invention relates to a jet recording method wherein droplets of a recording material are discharged or ejected to a recording medium.

In the jet recording method, droplets of a recording material (ink) are ejected to be attached to a recording medium such as paper for accomplishing recording. In the method disclosed in U.S. Pat. Nos. 4,410,899, and 4,723,129 assigned to the present assignee among the known jet recording methods, a bubble is generated in the ink by applying a heat energy to the ink, and an ink droplet is ejected through an ejection outlet (orifice), whereby a recording head provided with high-density multi-orifices can be easily realized to record a high-quality image having a high resolution at a high speed.

In addition to the above, known jet recording methods may include the following.

Japanese Laid-Open Patent Application (JP-A) 161935/1979 discloses a recording method as illustrated in FIG. 14, wherein a liquid ink 31 in a chamber is gasified by operation of a heater 30 energized through electrodes 35, and the resultant gas 32 is ejected together with an ink droplet 33 through an ejection outlet. It is said that the plugging of an orifice can be prevented due to ejection of the gas 32 through a nozzle.

JP-A 185455/1986 discloses a recording method as illustrated in FIGS. 15A–15C, wherein a liquid ink 44 filling a minute gap 43 between a plate member 41 having a pore 40 and a heat-generating head 42 is heated by the head 42 (FIGS. 15A and 15B), and an ink droplet 46 is ejected by the created bubble 45 through the pore 40 together with the gas constituting the bubble (FIG. 15C) to form an image on recording paper.

JP-A 249768/1986 discloses a recording method as illustrated in FIGS. 16A and 16B, wherein a liquid ink 50 is supplied with a heat energy by a heating member 51 to form a bubble, and an ink droplet 58 is ejected by expansion force of the bubble together with the gas constituting the bubble through a large aperture to the ambience.

JP-A 197246/1986 discloses a recording method as illustrated in FIG. 17, wherein ink 62 filling a plurality of bores 61 formed in a film 60 is heated by a recording head 64 having a heating element 63 to generate a bubble 67 in the ink 62, thus ejecting an ink droplet 65 onto a recording medium 66 (at (a)–(f) in order in FIG. 17).

Our research group has proposed a new jet recording method (hereinafter referred to as "bubble-through jet recording method"), wherein a recording material is supplied with a thermal energy corresponding to a recording signal to generate a bubble in the recording material so that a droplet of the recording material is discharged out of an ejection outlet under the action of the bubble, wherein the bubble is caused to communicate with the ambience. According to the bubble-through jet recording method, the splash or mist of the recording material is prevented. Further, according to bubble-through jet recording method, all the recording material between the created bubble and the ejection outlet is ejected, so that the discharged amount of the recording material droplet becomes constant depending on the shape of a nozzle and the position of a heater therein, whereby a stable recording becomes possible.

The inks used in the jet recording method are required to satisfy contradictory properties that they are quickly dried to be fixed on the recording medium but they do not readily plug a nozzle due to drying in the nozzle.

For complying with these requirements, the conventional normally liquid inks generally comprise water as a principal constituent and also contain a water-soluble high-boiling solvent, such as a glycol, for the purposes of preventing drying and plugging, etc. When such inks are used for recording on plain paper, there are encountered several problems such that the inks are not quickly dried to be fixed and the ink image immediately after the printing is liable to be attached to hands on touching and smeared, lowering the printing quality.

Further, the ink penetrability remarkably varies depending on the kind of recording paper, so that only special paper is usable when such conventional aqueous inks are used. In recent years, however, it is required to perform good recording on so-called plain paper, inclusive of copy paper, report paper, note book paper and letter paper.

In order to solve the above problems, there have been disclosed jet recording methods wherein a normally solid hot melt-type ink is heat-melted to be emitted in U.S. Pat. No. 5,006,170, JP-A 108271/1983, JP-A 83268/1986, JP-A 159470/1986, JP-A 48774/1987 and JP-A 54368/1980.

However, such a normally solid hot-melt-type ink is liable to pile up or form a relief image on recording paper. As a result, when the record face of the recording paper is rubbed, the ink can be peeled off in some cases. In order to prevent such pile up of ink, JP-A 1-242672 and JP-A 2-51570 have proposed a normally solid hot-melt-type ink containing a supercooling agent.

However, such a hot-melt-type ink containing a supercooling agent is liable to require an increased time for fixation, and soiling of hands with the recorded image or the disorder of the recorded image or the disorder of the recorded image is liable to be caused unless the recorded image is left standing for a sufficient time after the recording.

SUMMARY OF THE INVENTION

An object of the present invention is to provide an improvement in the bubble-through jet recording method proposed by our research group.

A more specific object of the present invention is to provide a jet recording method capable of providing recorded images which are excellent in resistance to rubbing and image quality.

According to the present invention, there is provided a jet recording method, comprising:

a preliminary step of placing a normally solid recording material in a heat-melted state in a path defined by a nozzle leading to an ejection outlet, and a recording step of imparting to the melted recording material a thermal energy corresponding to a recording signal to generate a bubble, thus ejecting a droplet of the recording material out of the ejection outlet under the action of the bubble to deposit the droplet on a recording medium;

wherein in the recording step, the bubble is caused to communicate with ambience, and the droplet is ejected in a diameter d (μm) and at an average speed v (m/sec) satisfying: $10 \leqq d \leqq 60$ and $7 \leqq v \leqq 20$.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 7 is a perspective illustration of an example of a system for measuring the volume of a recording method droplet protruded from an ejection outlet.

FIG. 8 shows a top plan view (a) and a side view (b) of a droplet, and a graph (c) showing the results given by the measurement using the system shown in FIG. 7.

DETAILED DESCRIPTION OF THE INVENTION

In the recording method according to the present invention providing an improvement in the bubble-through jet recording method proposed by our research group, a normally solid recording material (ink, i.e., a recording material which is solid at room temperature (5° C.–35° C.)) is melted under heating, and the melted recording material is supplied with a heat energy corresponding to given recording data to be ejected through an ejection outlet (orifice) for recording.

First of all, the bubble-through jet recording method proposed by our research group is described hereinbelow with reference to the drawings.

In the bubble-through jet recording method, when the recording material in a melted state is imparted with a heat energy corresponding to a recording signal, a bubble is created in the recording material and the created bubble generates an ejection energy for ejecting the recording material through an ejection outlet.

Figure 1:
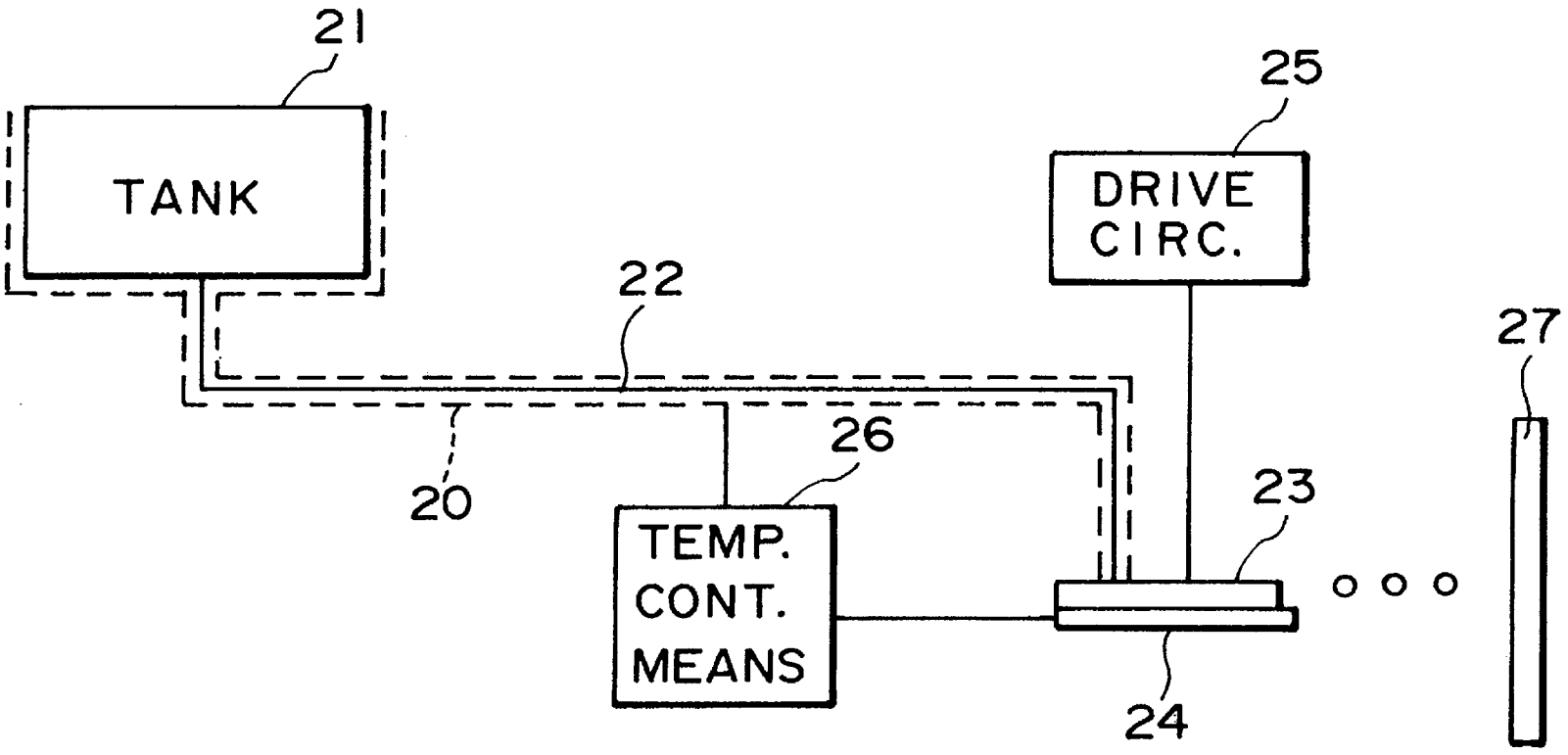
FIG. 1 is a schematic illustration of an embodiment of a recording apparatus for use in a recording method according to the invention.

FIG. 1 illustrates an apparatus for practicing the recording method according to the present invention, wherein a recording material contained in a tank 21 is supplied through a passages 22 to a recording head 23. The recording head 23 may for example be one illustrated in FIGS. 2A and 2B. The tank 21, passage 22 and recording head 23 are supplied with heat by heating means 20 and 24 to keep the recording material in a liquid state in the apparatus. The heating means 20 and 24 are set to a prescribed temperature, which may suitably be higher by 10°–50° C., preferably by 25°–35° C., than the melting point of the recording material, by a temperature control means 26. The recording head 23 is supplied with a recording signal from a drive circuit 25 to drive an ejection energy-generating means (e.g., a heater) in the recording head corresponding to the recording signal, whereby droplets of the recording material are discharged to effect recording on a recording medium 27, such as paper.

Figure 2A:
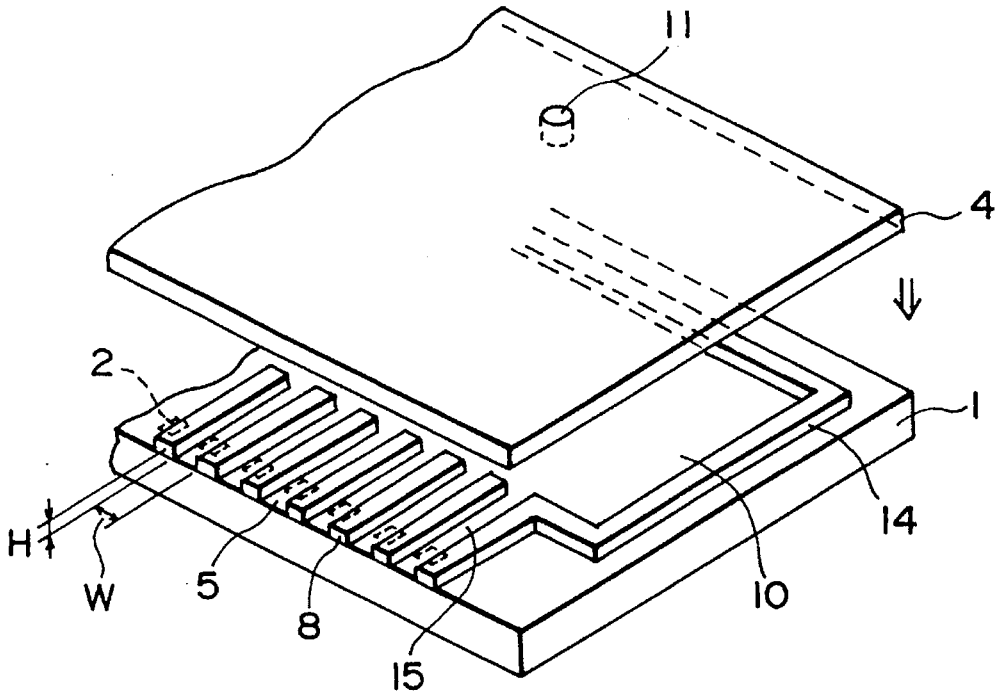
FIGS. 2A and 2B are a schematic partial perspective view and a schematic plan view of a recording head used in the recording apparatus shown in FIG. 1.
Figure 2B:
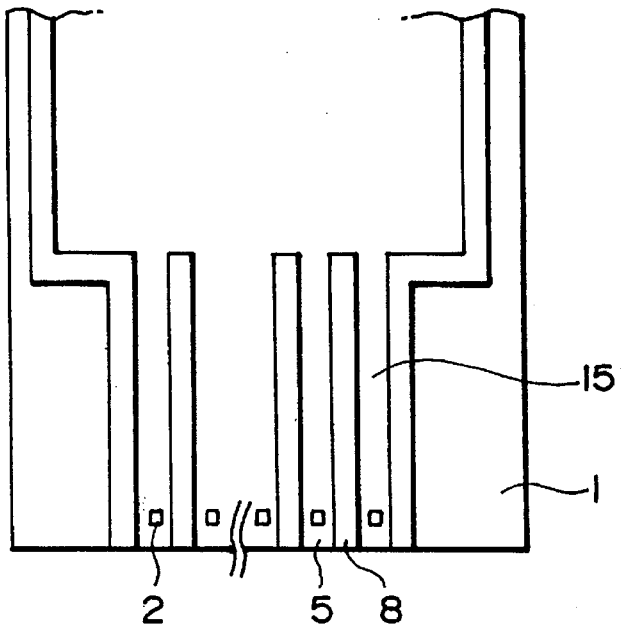

As shown in FIGS. 2A and 2B, the head 23 is provided with a plurality of walls 8 disposed in parallel with each other on a substrate 1 and a wall 14 defining a liquid chamber 10. On the walls 8 and 14, a ceiling plate 4 is disposed. In FIG. 2A, the ceiling plate 4 is shown apart from the walls 8 and 14 for convenience of showing an inside structure of the recording head. The ceiling plate 4 is equipped with an ink supply port 11, through which a melted recording material is supplied into the liquid chamber 10. Between each pair of adjacent walls 8, a nozzle 15 is formed for passing the melted recording material. At an intermediate part of each nozzle 15 on the substrate 1, a heater 2 is disposed for supplying a thermal energy corresponding to a recording signal to the recording material. A bubble is created in the recording material by the thermal energy from the heater 2 to eject the recording material through the ejection outlet 5 of the nozzle 15.

In the bubble-through jet recording method, when a bubble is created and expanded by the supply of thermal energy to reach a prescribed volume, the bubble thrusts out of the ejection outlet 5 to communicate with the ambience (atmosphere). This point is explained further hereinbelow.

Figure 3A:
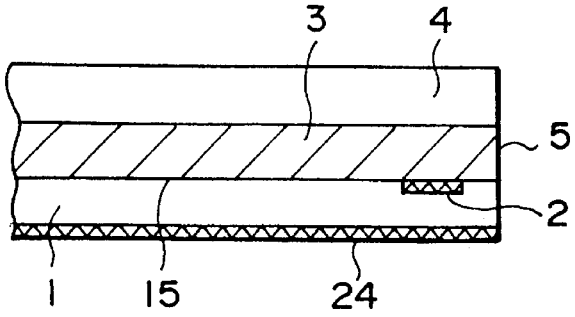
FIGS. 3A–3D are schematic sectional views of a recording head supplying a recording material for illustration of a principle of the recording method according to the invention.
Figure 3B:
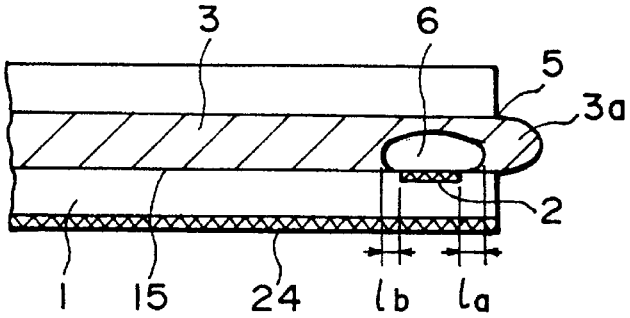
Figure 3C:
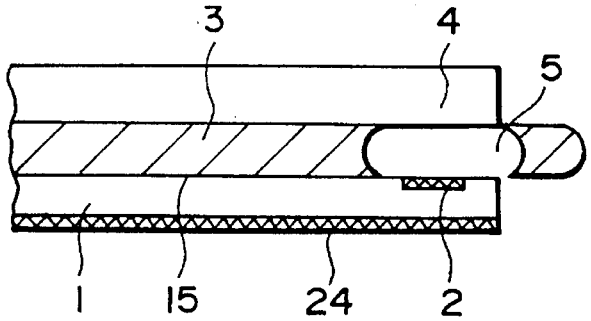
Figure 3D:
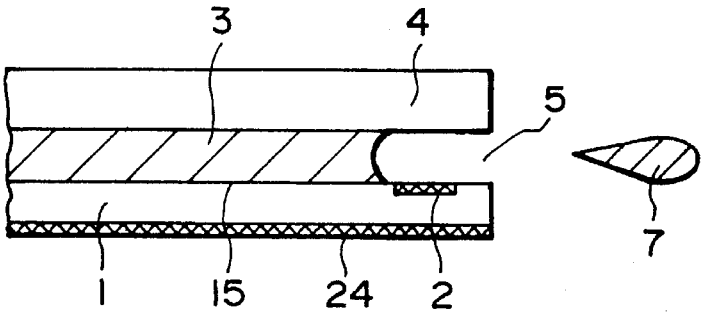

FIGS. 3A–3D show sections of a nozzle 15 formed in the recording head 23, including FIG. 3A showing a state before bubble creation. First, current is supplied to a heating means 24 to keep a normally solid recording material 3 melting. Then, the heater 2 is supplied with a pulse current to instantaneously heat the recording material 3 in the vicinity of the heater 2, whereby the recording material 3 causes abrupt boiling to vigorously generate a bubble 6, which further begins to expand (FIG. 3B). The bubble further continually expands and grows particularly toward the ejection outlet 5 providing a smaller inertance until it thrusts out of the ejection outlet 5 to communicate with the ambience (FIG. 3C). A portion of the recording material 3 which has been closer to the ambience than the bubble 6 is ejected forward due to kinetic momentum which has been imparted thereto by the bubble 6 up to the moment and soon forms a droplet to be deposited onto a recording medium, such as paper (not shown) (FIG. 3D). A cavity left at the tip of the nozzle 15 after the ejection of the recording material 3 is filled with a fresh portion of the recording material owing to the surface tension of the succeeding portion of the recording material and the wetness of the nozzle wall to restore the state before the ejection.

In the recording head 23, the heater 2 is disposed closer to the ejection outlet 5 than in the conventional recording head. This is the simplest structure adaptable for communication of a bubble with the ambience. The communication of a bubble with the ambience is further accomplished by desirably selecting factors, such as the thermal energy generated by the heater 2, the ink properties and various sizes of the recording head (distance between the ejection outlet and the heater 2, the widths and heights of the outlet 5 and the nozzle 15). The required closeness of the heater 2 to the ejection outlet 5 cannot be simply determined but, as a measure, the distance from the front end of the heater 2 to the ejection outlet (or from the surface of the heater 2 to the ejection outlet 5 in the cases of a recording head as shown in FIGS. 9A–9D) may preferably be 5–80 microns, further preferably 10–60 microns.

In order to ensure the communication of a bubble with the ambience, the nozzle 15 may preferably have a height H which is equal to or smaller than a width W thereof, respectively at the part provided with the heater 2 (FIG. 2A). In order to ensure the bubble communication with the ambience, the heater 2 may preferably have a height H which is 50–95%, particularly 70–90%, of the width W of the nozzle. Further, it is preferred that the recording material is melted under heating by the heating means 24 to have a viscosity of at most 100 cps.

It is further preferred that a bubble communicate with the ambience when the bubble reaches 70% or more, further preferably 80% or more, of a maximum volume which would be reached when the bubble does not communicate with the ambience.

Because the bubble created in the recording material communicates with the ambience in the bubble-through jet recording method, substantially all the portion of the recording material present between the bubble and the ejection outlet is ejected, so that the volume of an ejected droplet becomes always constant. In the conventional jet recording method, a bubble created in the recording material does not ordinarily communicate with the ambience but shrinks to disappear after reaching its maximum volume. In the conventional case where a bubble created in the recording material does not communicate with the ambience, not all but only a part of the portion of recording material present between the bubble and the ejection outlet is ejected.

In the jet recording method wherein a bubble does not communicate with the ambience but shrinks after reaching the maximum, the bubble does not completely disappear by shrinkage but remains on the heater in some cases. If a small bubble remains on the heater, there arises a problem that bubble creation and growth for ejecting a subsequent droplet are not normally accomplished due to the presence of such a small bubble remaining on the heater. In contrast thereto, in the bubble-through jet recording method wherein a bubble is communicated with the ambience, all the recording material present between the bubble and the ejection outlet is ejected so that such a small bubble is not allowed to remain on the heater.

In the bubble-through jet recording method, only a small inertance is present between the heater 2 and the ejection outlet 5 of the recording head 23, so that the kinetic momentum of a created bubble 6 is effectively imparted to a droplet 7. For this reason, even a material having a high viscosity which cannot be easily ejected according to the conventional recording method, such as a liquefied ink formed by heating a normally solid recording material to above its melting point, can be stably ejected. Further, in the bubble-through jet recording method, the ejection speed of the recording material becomes very fast because a bubble created in the recording material communicates with the ambience. Accordingly, a droplet of the recording material is attached accurately to an objective point on the recording medium, and even a normally solid recording material can be attached to the recording medium in a small thickness without pile-up. The attachment in a small thickness of the solid recording material on the recording medium is most advantageous in superposing several colors of recording materials on a single recording medium to form a multicolor image.

In the bubble-through jet recording method, it is preferred that a bubble created by the heater 2 is caused to communicate with the ambience out of the ejection outlet 5 when the internal pressure of the bubble is not higher than the ambient (atmospheric) pressure.

Figure 4:
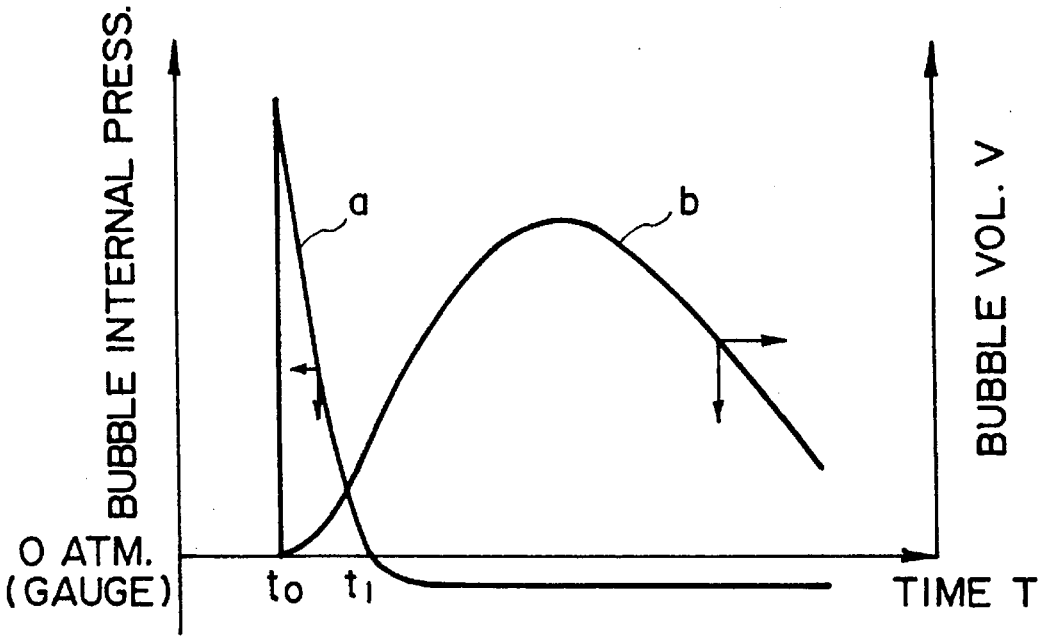
FIG. 4 is a graph showing an example of changes in internal pressure and volume of a bubble in the case of non-communication of the bubble with the ambience (atmosphere).

FIG. 4 is a graph showing a relationship between the internal pressure (curve a) and the volume (curve b), of a bubble in case where the bubble does not communicate with the ambience. Referring to FIG. 4, at time $T=t_0$ when the heater 2 is energized with a pulse current, a bubble is created in the recording material to cause an abrupt increase in bubble internal pressure and the bubble starts to expand simultaneously with the creation.

The bubble expansion does not cease immediately after the termination of current supply to the heater 2 but continues for a while thereafter. As a result, the bubble internal pressure abruptly decreases to reach a pressure below the ambient pressure (0 atm.-gauge) after $T=t_1$. After expansion to some extent, the bubble starts to shrink and disappears.

Figure 5:
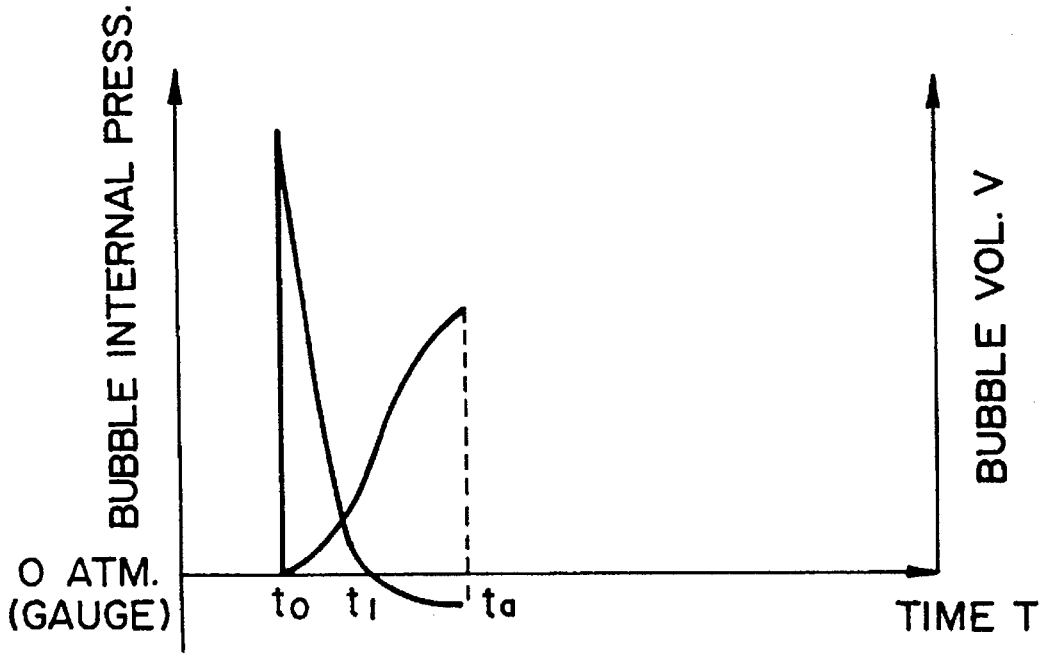
FIG. 5 is a graph showing an example of changes in internal pressure and volume of a bubble in the case of communication of the bubble with the ambience.

Accordingly, if the bubble is caused to communicate with the ambience at some time after time $T=t_1$, e.g., time $t_a$, as shown in FIG. 5, the bubble internal pressure immediately before the communication is lower than the ambient pressure.

If the bubble is communicated with the ambience to eject a droplet when the internal pressure thereof is below the ambient pressure, the formation of splash or mist of the recording material unnecessary for recording can be prevented, so that the soiling of the recording medium or the apparatus is avoided.

Hitherto, in the conventional jet recording method, there has been encountered a problem that splash or mist of the recording material is ejected in addition to a droplet effective for recording. The occurrence of such splash or mist can be prevented by lowering the bubble internal pressure to a value not higher than the ambient pressure when the bubble is communicated with the ambience in the bubble-through jet recording method.

It is difficult to directly measure the bubble internal pressure, but the satisfaction of the condition of the bubble internal pressure being smaller than the ambient pressure may be suitably judged in the following manner.

Figure 6:
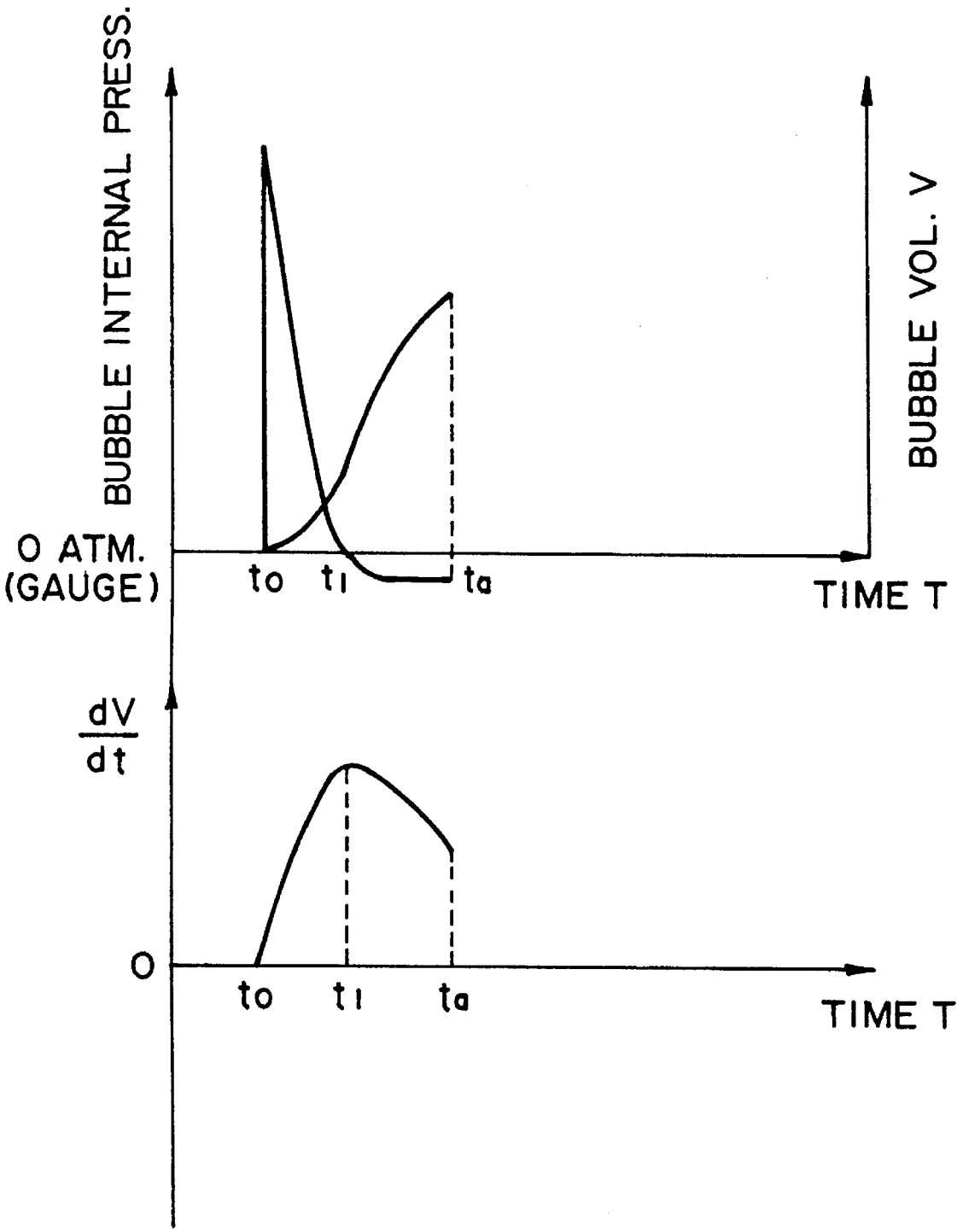
FIG. 6 is a graph showing an example of changes in internal pressure, volume and further volume-changing rate of a bubble in the case of communication of the bubble with the ambience.

The volume Vb of the bubble is measured from the start of the bubble creation to the communication thereof with the ambience. Then the second order differential $d^2Vb/dt^2$ is calculated, based on which the relative magnitudes of the internal pressure and the atmospheric pressure may be judged. If $d^2Vb/dt^2>0$, the internal pressure is higher than the ambient pressure. If $d^2Vb/dt^2 \leqq 0$, the internal pressure is not higher than the ambient pressure. Referring to FIG. 6, during a period of from the state of bubble creation at time $T=t_0$ to time $T=t_1$, the bubble internal pressure is higher than the ambient pressure ($d^2Vb/dt^2>0$), and during a period from time $T=t_1$ to the bubble communication with the ambience at time T=ta, the bubble internal pressure is lower than the ambient pressure. As described above, by calculating $d^2Vb/dt^2$, i.e., the second order differential of Vb, it is possible to know the relationship regarding magnitude between the bubble internal pressure and the ambient pressure.

Instead of measuring the above-mentioned bubble volume Vb, it is also possible to judge the relative magnitudes of the bubble internal pressure and the ambient pressure by measuring the volume Vd of a protrusion 3*a* (FIG. 3B) of the recording material out of the ejection outlet 5 (hereinafter called "ink protrusion 3*a*") in a period from the start of the bubble creation to the ejection of a droplet of the recording material (a period between the states shown in FIGS. 3*a* and 3C) and calculating the second order differential of Vd, i.e., $d^2Vd/dt^2$. More specifically, if $d^2Vd/dt^2>0$, the bubble internal pressure is higher than the ambient pressure, and if $d^2Vd/dt^20$, the bubble internal pressure is not higher than the ambient pressure.

The volume Vd of the ink protrusion 3*a* at various points of time may be measured by observation through a microscope of the ink protrusion 3*a* while it is illuminated with pulse light from a light source such as a stroboscope, LED or laser. The pulse light is emitted to the recording head driven at regular intervals for continuously ejecting droplets with synchronization with drive pulses for the recording head and with a predetermined delay, whereby the projective configuration of the ink protrusion 3*a* is seen in one direction at prescribed points of time. The pulse width of the pulse light is preferably as small as possible, provided that the quantity of the light is sufficient for the observation, so as to allow an accurate determination of the configuration. It is possible to roughly calculate the volume of the ink protrusion 3*a* by measurement in only one direction. For a more accurate determination, however, it is preferred to measure the configurations of the ink protrusion 3*a* simultaneously in two directions y and z which are perpendicular to each other and are respectively perpendicular to direction x in which droplets are ejected, as shown in FIG. 7. It is desirable that either one of the directions y and z for observation by microscopes 201 is disposed parallel to the direction of arrangement of the ejection outlets 5.

Referring to FIG. 8, based on the observed images in the two directions y and z as shown at (a) and (b), the widths a(x) and b(x) along the x-axis of the ink protrusion 3*a* are measured. Using the measured widths a(x) and b(x) as functions of x as shown at (c), the volume Vd of the ink projection at a predetermined delay period can be calculated from the following equation:

$$Vd=(\pi/4)\int a(x)\cdot b(x)dx.$$

The above equation is based on approximation of the y-x cross-section of the ink projection 3*a* as an oval shape and is usable for calculation of volume of the ink projection 3*a* or bubble 6 at a sufficiently high accuracy.

Further, by gradually changing the delay period of the pulse light from the light source 200 from zero for a plurality of ink projections, the change in volume Vd with time of an ink projection from the creation of a bubble to the ejection of a corresponding droplet can be approximately obtained.

The volume Vb of a bubble in the nozzle 15 can be also measured by application of the method illustrated in FIG. 7. In this case for measurement of the bubble volume Vb, however, it is necessary to form a part of the recording head with a transparent member so that the bubble can be observed from outside the recording head.

In order to determine the behavior of the ink projection 3*a* and the bubble, a time resolution power of about 0.1 micro-sec is required, so that the pulse light source may preferably comprise an infrared LED and have a pulse width of about 50 n.sec., and the microscope 201 may preferably be connected to an infrared camera so as to photograph the image.

Further, if the bubble is communicated with the ambience when the first order differential of the moving speed of the bubble front in the ejection direction is negative, the occurrence of mist or splash can be further prevented.

Referring to FIG. 3B, if the distance $1_a$ from the ejection outlet 5 side end of the heater 2 as the ejection energy generating means to the front end (ejection outlet 5 side end) of a bubble 6 and the distance $1_b$ from the opposite side end of the heater 2 to the rear end (on the side opposite to the ejection outlet 5) of the bubble are set to satisfy $1_a/1_b \geqq 1$, preferably $1_a/1_b \geqq 2$, more preferably $1_a/1_b \geqq 4$, at an instant immediately before the communication with the ambience, it is possible to shorten the time for filling the cavity formed after ejection of the recording head with a fresh portion of the recording material, thus realizing a further high-speed recording. The ratio $1_a/1_b$ may be increased, e.g., by shortening the distance between the heater 2 and the ejection outlet 5.

Figure 9A:
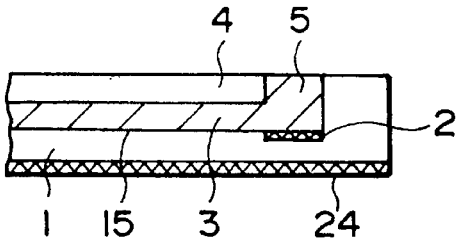
FIGS. 9A–9D are schematic sectional views of another example of a recording head supplying a recording material for illustration of a principle of the recording method according to the invention.
Figure 9B:
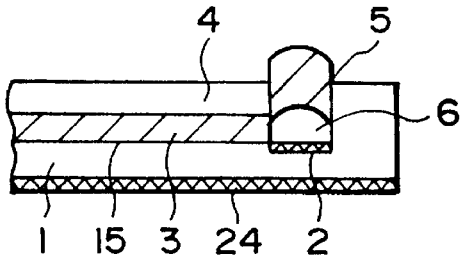
Figure 9C:
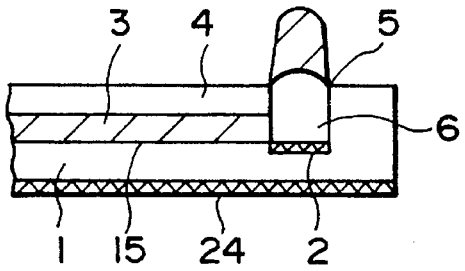
Figure 9D:
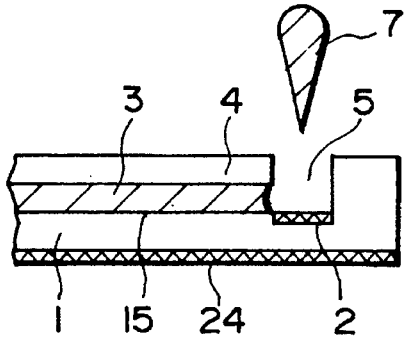

FIGS. 9A–9D illustrate another embodiment of the recording head used in the present invention which includes an ejection outlet 5 disposed on a lateral side of a nozzle 15. Also in the case of using the recording head shown in FIGS. 9A–9D, a bubble 6 is caused to communicate with the ambience similarly as in the case of using the head shown in FIGS. 3A–3D. More specifically, from a state of before bubble generation in FIG. 9A, a recording material 3 melted under operation of a heating means 24 is heated by energizing a heater 2 to create a bubble 6 on the heater 2 (FIG. 9B). The bubble 6 continues to expand (FIG. 9C) until it communicates with the ambience to eject a droplet 7 out of the ejection outlet 5 (FIG. 9D).

According to the present invention, in the bubble-through jet recording method, the recording material is ejected in a controlled manner so as to form a droplet having a diameter d (μm) of $10 \leqq d \leqq 60$ and ejected at an average velocity v (m/sec) of $7 \leqq v \leqq 20$.

If the droplet diameter d is too small, the flying course of the ejected droplet is fluctuated, thus failing to effect a stable discharge. On the contrary, if the droplet diameter is too large, the droplet is liable to pile up on the recording medium, thus providing a recorded image inferior in resistance to rubbing.

The pileup of the recording material on the recording medium is more pronounced if the average speed of the droplet is smaller. Reversely, if the average speed of the droplet is too large, the recording material is scattered on the recording medium to soil a region around the record dot.

It is further preferred that the droplet diameter d (μm) satisfies $15 \leqq d \leqq 60$, particularly $15 \leqq d \leqq 40$, and the average velocity v (m/sec) of the droplet satisfies $7 \leqq v \leqq 15$.

Herein, the droplet diameter d (μm) means a calculated value from the volume $V_0$ ($\mu m^3$) of the droplet based on the following equation (A):

$$d=(6V_0/\pi)^{1/3} \quad \text{(A).}$$

The droplet volume $V_0$ ($m^3$) may be obtained by ejecting a prescribed number of droplets of the recording material through a single ejection outlet and weighing the total weight of the ejected droplets to calculate the droplet volume $V_0$ based on the number and total weight of the droplets and the density of the recording material in a molten state. The number of droplets to be used for calculating the droplet diameter in this manner should be on the order of $10^6$.

The number of droplets ejected through a single ejection outlet on application of a single ejection signal is not always one, but extremely minute droplets can gather around a single main droplet like satellites in some case. In that case, such minute droplets in the form of satellites are neglected from the number of droplets for the calculation while noticing only the largest droplet.

The average velocity v (m/sec) of a droplet may be obtained by using an apparatus as shown in FIG. 7, whereby the distance of a droplet moving in 50 μsec from the instant of the ejection out of the ejection outlet may be measured by a display (not shown) connected to the microscope 201 to calculate the velocity based on the distance and the 50 μsec.

Figure 10:
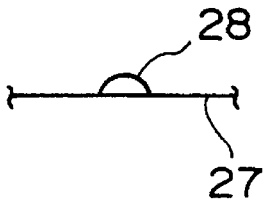
FIG. 10 is a side view of a single dot on a recording medium formed by a single droplet of a recording material according to an embodiment of the recording method according to the invention.
Figure 11:
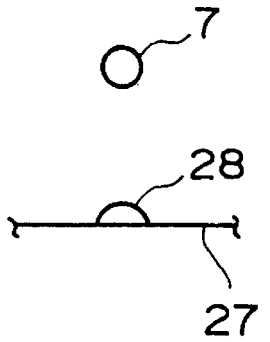
FIG. 11 is a side view illustrating an embodiment of the recording method according to the invention wherein a droplet of a recording material is being deposited in superposition on a dot formed by a single droplet of the recording material.
Figure 12:
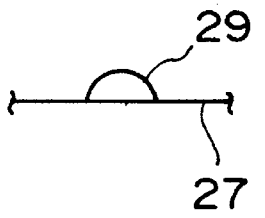
FIG. 12 is a side view of a single dot on a recording medium formed by two droplets of a recording material according to an embodiment of the invention.

Incidentally, if plural droplets of recording material are deposited in superposition on a single spot of the recording medium as shown in FIGS. 10–12, a single record dot can be provided with a controlled gradational level. More specifically, a dot 28 composed by a single droplet as shown in FIG. 10 has a different gradation level from a dot 29 as shown in FIG. 12 which has been formed by depositing a further one droplet on a dot 28 already formed by deposition of a single droplet on the recording medium 27 as shown in FIG. 11. Accordingly, in the case where three droplets at the maximum are allowed to be deposited in superposition on a single spot, a recording can be performed at totally four gradation levels including the level of no dot formation.

In the case where a single dot is formed by deposition of plural droplets in superposition at a single spot according to necessity, it is appropriate that each droplet d (μm) satisfies $10 \leqq d \leqq 30$.

The recording material used in the jet recording method according to the present invention is normally solid, i.e., solid at room temperature (5° C.–35° C.).

The normally solid recording material used in the present invention may comprise at least a heat-fusible solid substance and a colorant, and optionally additives for adjusting ink properties and a normally liquid organic solvent, such as an alcohol.

The normally solid recording material may preferably have a melting point in the range of 36° C. to 200° C. Below 36° C., the recording material is liable to be melted or softened according to a change in room temperature to soil hands. Above 200° C., a large quantity of energy is required for liquefying the recording material. More preferably, the melting point is in the range of 36° C.–150° C.

The heat-fusible substance contained in the normally solid recording material may, for example, include: acetamide, p-vaniline, o-vaniline, dibenzyl, m-acetotoluidine, phenyl benzoate, 2,6-dimethylquinoline, 2,6-dimethoxyphenol, p-methylbenzyl alcohol, p-bromoacetophenone, homo-catechol, 2,3-dimethoxybenzaldehyde, 2,4-dichloroaniline, dichloroxylylene, 3,4-dichloroaniline, 4-chloro-m-cresol, p-bromophenol, dimethyl oxalate, 1-naphthol, dibutylhydroxytoluene, 1,3,5-trichlorobenzene, p-tertpentylphenol, durene, dimethyl-p-phenylenediamine, tolan, styrene glycol, propionamide, diphenyl carbonate, 2-chloronaphthalene, acenaphthene, 2-bromonaphthalene, indole, 2-acetylpyrrole, dibenzofuran, p-chlorobenzyl alcohol, 2-methoxynaphthalene, tiglic acid, p-dibromobenzene, 9-heptadecanone, 1-tetradecanamine, 1,8-octanediamine, glutaric acid, 2,3-dimethylnaphthalene, imidazole, 2-methyl-8-hydroxyquinoline, 2-methylindole, 4-methylbiphenyl, 3,6-dimethyl-4-octynediol, 2,5-dimethyl-3-hexyne-2,5-diol, 2,5-dimethyl-2,5hexanediol, ethylene carbonate, 1,8-octane diol, 1,1-diethylurea, butyl p-hydroxybenzoate, methyl 2-hydroxynaphthoate, 8-quinolinol, stearylamine acetate, 1,3-diphenyl-1,3-propanedione, methyl m-nitrobenzoate, dimethyl oxalate, phthalide, 2,2-diethyl-1,3-propanediol, N-tert-butylethanolamine, glycolic acid, diacetylmonooxime, and acetoxime. These heat-fusible substances may be used singly or in mixture of two or more species.

The above-mentioned heat-fusible substances include those having various characteristics, such as substances having particularly excellent dischargeability, substances having particularly excellent storability and substances providing little blotting on a recording medium. Accordingly, these heat-fusible substances can be selected depending on desired characteristics.

A heat-fusible substance having a melting point Tm and a boiling point Tb (at 1 atm. herein) satisfying the following formulae (A)and (B) may preferably be used so as to provide a normally solid recording material which is excellent in fixability of recorded images and can effectively convert a supplied thermal energy to a discharge energy.

$$36° \text{ C.} \leqq Tm \leqq 150° \text{ C.} \quad \text{(A)}$$

$$150° \text{ C.} \leqq Tb \leqq 370° \text{ C.} \quad \text{(B)}$$

The boiling point Tb may preferably satisfy $200° \text{ C.} \leqq Tb \leqq 340° \text{ C.}$ The colorant contained in the normally solid recording material may include known ones inclusive of various dyes, such as direct dyes, acid dyes, basic dyes, disperse dyes, vat dyes, sulfur dyes and oil-soluble dyes, and pigments. A particularly preferred class of dyes may include oil-soluble dyes, including those described below disclosed in the color index:

C.I. Solvent Yellow 1, 2, 3, 4, 6, 7, 8, 10, 12, 13, 14, 16, 18, 19, 21, 25, 25:1, 28, 29, etc.;

C.I. Solvent Orange 1, 2, 3, 4, 4:1, 5, 6, 7, 11, 16, 17, 19, 20, 23, 25, 31, 32, 37, 37:1, etc.;

C.I. Solvent Red 1, 2, 3, 4, 7, 8, 13, 14, 17, 18, 19, 23, 24, 25, 26, 27, 29, 30, 33, 35, etc.;

C.I. Solvent Violet 2, 3, 8, 9, 10, 11, 13, 14, 21, 21:1, 24, 31, 32, 33, 34, 36, 37, 38, etc.;

C.I. Solvent Blue 2, 4, 5, 7, 10, 11, 12, 22, 25, 26, 35, 36, 37, 38, 43, 44, 45, 48, 49, etc.;

C.I. Solvent Green 1, 3, 4, 5, 7, 8, 9, 20, 26, 28, 29, 30, 32, 33, etc.;

C.I. Solvent Brown 1, 1:1, 2, 3, 4, 5, 6, 12, 19, 20, 22, 25, ,28, 29, 31, 37, 38, 42, 43, etc.; and C.I. Solvent Blank 3, 5, 6, 7, 8, 13, 22, 22:1, 23, 26, 27, 28, 29, 33, 34, 35, 39, 40, 41, etc.

It is also preferred to use inorganic pigments, such as calcium carbonate, barium sulfate, zinc oxide, lithopone, titanium oxide, chrome yellow, cadmium yellow, nickel titanium yellow, naples yellow, yellow iron oxide, red iron oxide, cadmium red, cadmium mercury sulfide, Prussian blue, and ultramarine; carbon black; and organic pigments, such as azo pigments, phthalocyanine pigments, triphenylmethane pigments and vat-type pigments.

The normally solid recording material can further contain a normally liquid organic solvent, as desired, examples of which may include alcohols, such as 1-hexanol, 1-heptanol, and 1-octanol; alkylene glycols, such as ethylene glycol, propylene glycol, and triethylene glycol; ketones, ketone alcohols, amides, and ethers. Such an organic solvent may have a function of enlarging the size of a bubble generated in the recording material and may preferably have a boiling point of at least 150° C.

The normally solid recording material can further contain optional additives, such as antioxidants, dispersing agents and anti-corrosion agents.

The normally solid recording material may preferably contain 50–99 wt. %, particularly 60–95 wt. %, of a heat-fusible substance; 1–20 wt. %, particularly 3–15 wt. %, of a colorant; and 0–10 wt. % of an optionally added organic solvent.

The recording material used in the recording method according to the present invention may preferably have a surface tension $\gamma$ (dyne/cm) satisfying $\gamma \geqq 20$, particularly $20 \leqq \gamma \leqq 40$, at a temperature given under heating by the heating means 24 (FIG. 1). If the surface tension $\gamma$ is too small, the recording material is liable to be excessively penetrating when deposited on the recording medium, thus failing to provide a clear recorded image on the recording medium. On the other hand, if the surface tension $\gamma$ is too large, the recording material is liable to pile up on the recording medium.

Further, the recording material may preferably have a viscosity $\eta$ (cP) at 100° C. satisfying $1.5 \leqq \eta \leqq 10$, particularly $1.5 \leqq \eta \leqq 5.0$. If the viscosity $\eta$ is too small, the ejected recording material is liable to cause splash or mist, and if the viscosity $\eta$ is too large, the recording material is liable to pile up on the recording medium.

Herein, the value of surface tension $\gamma$ is based on measurement by a Wilhelmy-type surface tension meter, and the value of viscosity $\gamma$ is based on measurement by a Brookfield-type rotary viscometer. For the measurement, the recording material may be held at a prescribed temperature on a water bath or oil bath.

Hereinbelow, the present invention is described more specifically with reference to Examples and Comparative Example.

EXAMPLES 1–7

| | |
|---|---|
| <Ink 1> | |
| C.I. Solvent Black 3 | 6 wt. % |
| Ethylene carbonate | 41 wt. % |
| 1,12-Dodecanediol | 53 wt. % |
| <Ink 2> | |
| C.I. Solvent Yellow 162 | 4 wt. % |
| Acetamide | 40 wt. % |
| Stearic acid | 56 wt. % |
| <Ink 3> | |
| C.I. Solvent Blue 38 | 3 wt. % |
| Acetamide | 30 wt. % |
| Cetyl alcohol | 45 wt. % |
| Behenic acid | 22 wt. % |

-continued

| | |
|---|---|
| <Ink 4> | |
| C.I. Solvent Black 3 | 3 wt. % |
| Acetamide | 50 wt. % |
| Carnauba wax ("Carnauba No. 1", mfd. by Noda Wax K.K.) | 30 wt. % |
| Stearic acid | 17 wt. % |
| <Ink 5> | |
| C.I. Solvent Red 49 | 2 wt. % |
| Ethylene carbonate | 30 wt. % |
| 1,12-Dodecanediol | 30 wt. % |
| 1,10-Decanediol | 38 wt. % |
| <Ink 6> | |
| C.I. Solvent Black 3 | 6 wt. % |
| Paraffin wax | 84 wt. % |
| Stearic acid | 10 wt. % |
| <Ink 7> | |
| C.I. Solvent Red 49 | 11 wt. % |
| 12-Hydroxystearic acid | 71 wt. % |
| 1,10-Decanedil | 18 wt. % |

Each of the above ink compositions was stirred at 100° C., filtered under heating to remove insolubles and cooled to obtain normally solid Inks 1–7.

The respective Inks 1–7 were separately incorporated and held in a molten state at 100° C. in an apparatus as shown in FIG. 1 equipped with a recording head as illustrated in FIGS. 2A and 2B and then used for recording on commercially available copy paper.

The recording head was composed to have 48 nozzles 15 at a rate of 400 nozzles/inch. Each nozzle had a height H of 26 μm and a width W of 38 μm and was provided with a heater 2 measuring 30 μm in width and 42 μm in length and disposed with a spacing of 20 μm from the orifice (ejection outlet) 5 to its front end.

During the recording, each heater 2 in the recording head was supplied with a voltage pulse of 14–18 volts in amplitude (varied depending on the ink used) and 2.5 μsec in width at a frequency of 1 kHz.

The recording was performed to provide a recorded image of a checker pattern having white (colorless) and colored 5 mm squares alternating one by one. The recorded images were evaluated with respect to quality and resistance to rubbing. The results of evaluation are summarized in Table 1 appearing hereinafter.

The rubbing resistance of the recorded images was evaluated by rubbing the recorded images with a filter paper (of Rank No. 2 available from Toyo Roshi K.K.) three times and observing the rubbed images with eyes.

The quality of the recorded images was evaluated by leaving the recorded images standing for 5 minutes and then observing the recorded images with eyes with respect to blurring and scattering of ink around the recorded pattern.

Further, the respective inks were subjected to the measurement of the viscosity $\eta$ (cP) at 100° C., surface tension $\gamma$ (dyne/cm) at the operating temperature (100° C.), droplet diameter d and average velocity v (m/sec) in the above-described manner. The results are also shown in Table 1 appearing hereinafter.

Incidentally, the recording and evaluation were performed in an environment of 20±5° C. and 50±10% R.H. (similarly as in Comparative Examples 1–2 and Example 8 described hereinafter).

Figure 13:
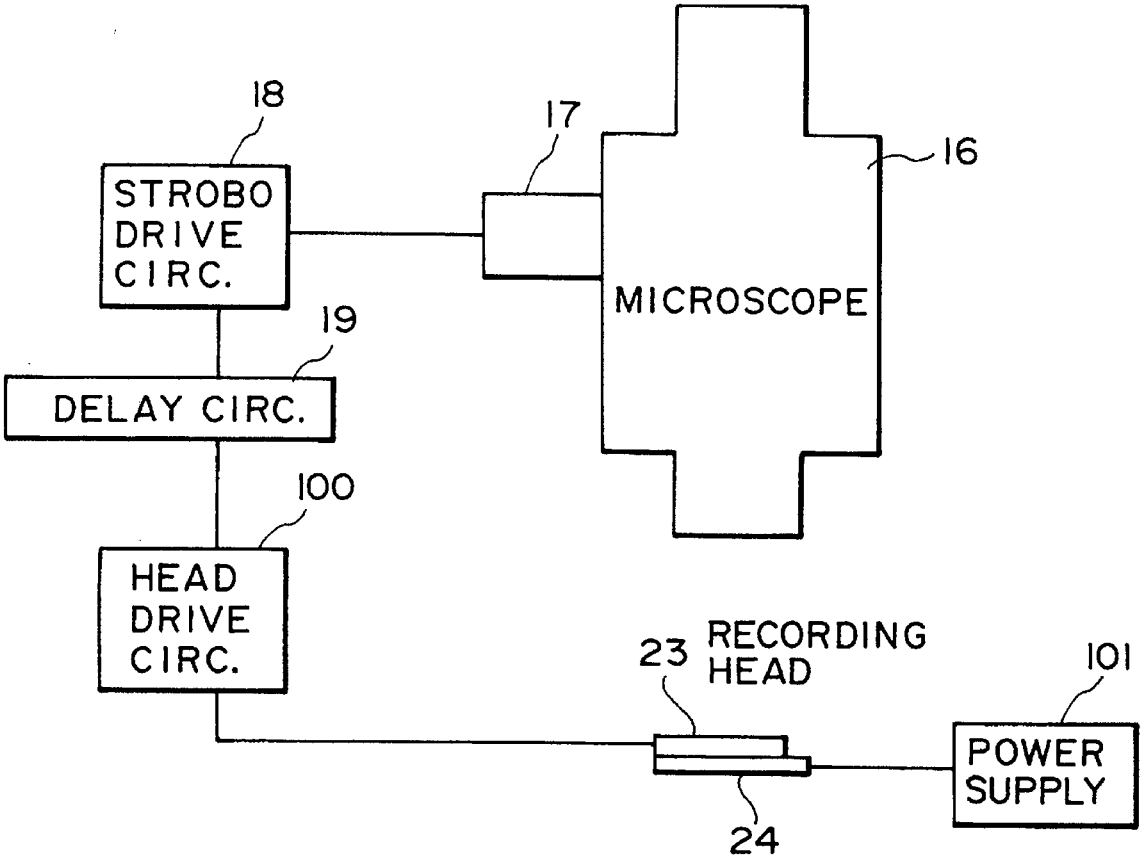
FIG. 13 is a schematic illustration of an embodiment of a recording apparatus designed so that a bubble-forming state and an ejected state of a recording material can be observed.
Figure 14:
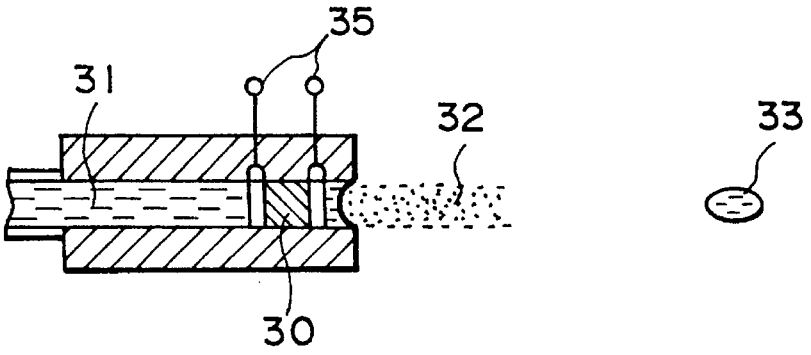
FIG. 14 is a sectional view for illustrating a known recording method.
Figure 15A:
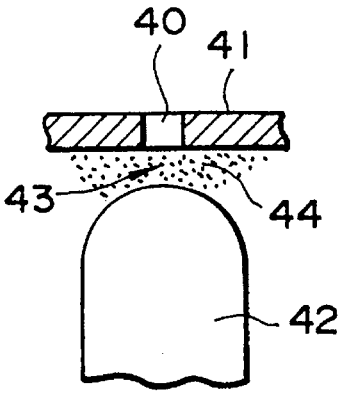
FIGS. 15A–15C are sectional views for illustrating another known recording method.
Figure 15B:
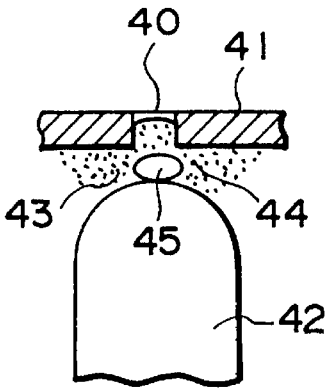
Figure 15C:
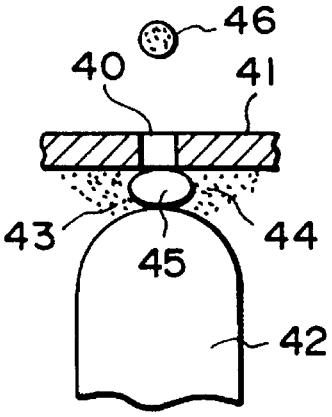
Figure 16A:
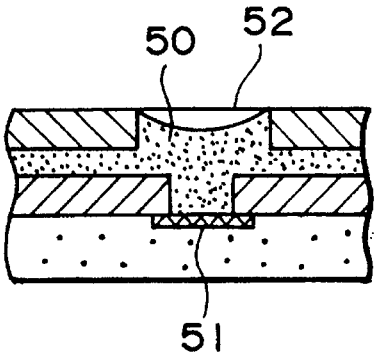
FIGS. 16A and 16B are sectional views for illustrating another known recording method.
Figure 16B:
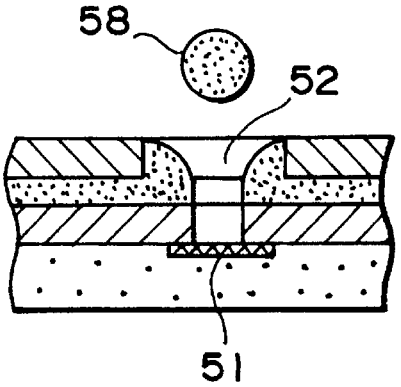
Figures 17A, 17B, 17C, 17D, 17E, 17F:
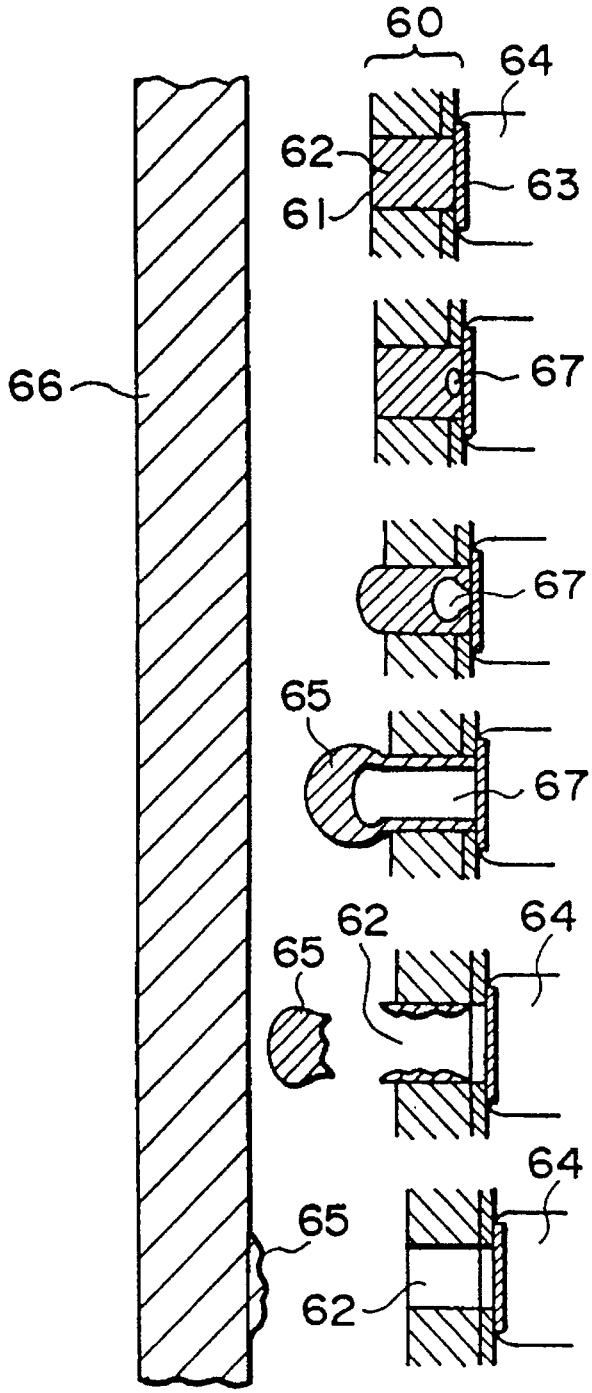
FIG. 17 shows a set of sectional views including a recording medium on a left side and a set of nozzles containing an ink in sequential states of heating and ink ejection at (a)–(f) on a right side.

Separately from the above, normally solid inks identical to those used in the above recording test except for omission of the colorants were respectively used in a similar recording test in an apparatus shown in FIG. 13, which was constituted to allow observation of a bubble formation in nozzles. The colorants were omitted so as to allow easier observation of a bubble.

The recording head 23 used in the apparatus of FIG. 13 was the same as the one used in the above recording test, but was modified to allow observation of the inside by using a transparent ceiling plate 4 (FIG. 2A). Above the recording head 23 was disposed a microscope 16 so as to be able to observe the inside of the nozzles 15 through the transparent ceiling plate. A strobo 17 was attached to the microscope 16 so as to allow the observation of the bubble forming and discharge of the ink only when the strobo 17 flashed. The strobo 17 was disposed so that it flashed after lapse of an arbitrarily settable delay time from the commencement of heat application from the heater 2 by means of a strobo drive circuit 18 and a delay circuit 19. The recording head 23 was equipped with a heating means 24 connected to an external power supply 101 so as to heat the recording head 23 at 100° C. to keep the ink in a molten state. The head 23 was driven by a head drive circuit 100. Thus, the ink in a molten state filling the ink chamber 10 in the recording head 23 and supplied to the nozzles 15 was heated by the heaters 2 energized with a pulse current, so that bubbles generated on the heaters 2 were observed at varying delay time for strobo flashing. As a result, it was observed that each bubble was allowed to communicate with the ambience about 3 μsec after the initiation of the bubble formation and the respective inks were stably discharged.

COMPARATIVE EXAMPLES 1 AND 2

| <Ink 8> | |
|---|---|
| C.I. Solvent Yellow 56 | 5 wt. % |
| Candelilla wax ("Candelilla Special", mfd. by Noda Wax K.K.) | 40 wt. % |
| 1,12-Dodecanediol | 55 wt. % |

The above ink composition was stirred at 100° C., filtered under heating to remove insolubles and cooled to form normally solid Ink 8.

The thus-prepared Ink 8 (Comparative Example 1) and Ink 3 used in Example 3 (Comparative Example 2) were respectively incorporated and held at in a molten state at 100° C. in an apparatus similar to the one shown in FIG. 1 but equipped with a piezoelectric recording head and then used for recording on commercially available copy paper. The resultant recorded images were evaluated similarly as in Examples 1–7. The results are also shown in Table 1 appearing hereinafter.

The piezoelectric recording head used was formed by remodeling a commercially available piezoelectric recording head ("PJ 1080A", mfd. by Canon K.K.) using a piezoelectric vibrator as an energy source for ink ejection to be provided with a heating means for heating the ink at 100° C.

The piezoelectric recording head had four nozzles each having a circular outlet of 65 μm in diameter and was driven by applying voltages of 40–85 V (varied depending on the ink used) at a frequency of 3.1 kHz.

TABLE 1

| | Ink | Viscosity (cp) | Surface tension (dyne/cm) | Droplet diameter d (μm) | Average velocity v (m/sec) | Rubbing resistance | Quality |
|---|---|---|---|---|---|---|---|
| Example | | | | | | | |
| 1 | 1 | 3.9 | 38.1 | 41 | 16 | ⊙ | ⊙ |
| 2 | 2 | 5.0 | 23.2 | 48 | 13 | ⊙ | ⊙ |
| 3 | 3 | 8.1 | 25.0 | 34 | 9 | ⊙ | ⊙ |
| 4 | 4 | 8.9 | 29.1 | 33 | 8 | ⊙ | ⊙ |
| 5 | 5 | 6.8 | 33.0 | 51 | 12 | ⊙ | ⊙ |
| 6 | 6 | 5.9 | 17.5 | 45 | 15 | ⊙ | ○ |
| 7 | 7 | 12.0 | 29.0 | 53 | 11 | ○ | ⊙ |
| Comp. Example | | | | | | | |
| 1 | 8 | 14.2 | 28.0 | 73 | 8 | x | ⊙ |
| 2 | 3 | 8.1 | 25.0 | 36 | 6 | x | ○ |

In the above Table 1, the rubbing resistance and the quality were evaluated according to the following standards.

<Rubbing Resistance>

⊙: No lack due to peeling of the recorded image is observed.

○: Slight lack due to peeling of the recorded image is observed in a degree of particularly no problem.

X: The recorded imaged is erased by rubbing.

<Quality>

⊙: No blurring or scattering is observed. Good.

○: Slight burring or scattering is observed in a degree of practically no problem.

EXAMPLE 8

Ink 1 used in Example 1 was incorporated and held in a molten state at 100° C. in an apparatus as shown n FIG. 1 equipped with a recording head as shown in FIGS. 2A and 2B and then used for recording on copy paper in such a manner that each record dot was formed by 1–3 droplets (i.e., 3 droplets at the maximum) deposited in superposition on a single spot of the copy paper.

The recording head was composed to have 44 nozzles 15 at a rate of 400 nozzles/inch. Each nozzle had a height H of 18 μm and a width W of 25 μm and was provided with a heater 2 measuring 22 μm in width and 24 μm in length and disposed with a spacing of 16 μm from the orifice (ejection outlet) 5 to its front end.

During the recording, each heater 2 in the recording head was supplied with a voltage pulse of 16.0 volts in amplitude and 2.5 μsec in width at a frequency of 1 kHz.

As a result of the recording, a dot formed by a single droplet of the ink showed a diameter of 51 μm, a dot formed by two droplets showed a diameter of 64 μm, and a dot formed by three droplets showed a diameter of 72 μm. Herein, the diameter refers to a true circle-approximated diameter, i.e., a diameter of a true circle having an identical aerial size with the dot concerned.

The resultant three types of record dots were evaluated with respect to the rubbing resistance and quality in the same manner as in Examples 1–7. As a result, they showed quite satisfactory rubbing resistance and quality.

Further, as a result of measurement in the above-described manner, the ejected droplet diameter d (μm) and average velocity v (m/sec) were 28 (μm) and 12 (m/sec), respectively.

As described above, according to the jet recording method of the present invention, recorded images having excellent resistance to rubbing and excellent quality can be formed by a normally solid recording material without causing pileup or scattering of the recording material on a recording medium.

What is claimed is:

1. A jet recording method, comprising:

a preliminary step of placing a normally solid recording material in a heat-melted state in a path defined by a nozzle leading to an ejection outlet, and a recording step of imparting to the melted recording material a thermal energy corresponding to a recording signal to generate a bubble, thus ejecting a droplet of the recording material out of the ejection outlet by an action of the bubble to deposit the droplet on a recording medium;

wherein in the recording step, the bubble is caused to communicate with ambience, and the droplet is ejected in a diameter d, μm, and at an average speed v, m/sec satisfying: $10 \leqq d \leqq 60$ and $7 \leqq v \leqq 20$.

2. A method according to claim 1, wherein the bubble communicates with the ambience when the bubble has an internal pressure not higher than ambient pressure.

3. A method according to claim 1, wherein the droplet diameter d, μm, satisfies $15 \leqq d \leqq 60$.

4. A method according to claim 1, wherein the average velocity v, m/sec, satisfies $7 \leqq v \leqq 15$.

5. A method according to claim 1, wherein a plurality of the droplets is deposited in superposition on the recording medium.

6. A method according to claim 5, wherein the droplet diameter d, μm, satisfies $10 \leqq d \leqq 30$.

7. A method according to claim 1, wherein the recording material has a surface tension, dyne/cm, satisfying $\gamma \geqq 20$ in the molten state.

8. A method according to claim 1, wherein the recording material has a surface tension, dyne/cm, satisfying $20 \leqq \gamma \leqq 40$ in the molten state.

9. A method according to claim 1, wherein the recording material has a viscosity, cP, at 100° C., satisfying $1.5 \leqq \eta \leqq 10$.

10. A method according to claim 1, wherein the recording material has a viscosity, cP, at 100° C., satisfying $1.5 \leqq \eta \leqq 5.0$.

* * * * *

UNITED STATES PATENT AND TRADEMARK OFFICE

CERTIFICATE OF CORRECTION

PATENT NO. : 5,621,447 Page 1 of 2

DATED : April 15, 1997

INVENTOR(S) : YOSHIHISA TAKIZAWA, ET AL.

It is certified that error appears in the above-identified patent and that said Letters Patent is hereby corrected as shown below:

On the title page, item:

[45] Date of Patent:

"April 15, 1997" should read --* April 15, 1997--.

Between [73]
and [21]

Insert "[*] Notice: The term of this patent shall not extend beyond the expiration date of Pat. No. 5,270,730."

[63] Related U.S. Application Data

"Continuation-in-part" should read --Continuation--.

COLUMN 2

Line 13, "fixed" should read --fixed,--.

UNITED STATES PATENT AND TRADEMARK OFFICE

CERTIFICATE OF CORRECTION

PATENT NO. : 5,621,447 Page 2 of 2

DATED : April 15, 1997

INVENTOR(S) : YOSHIHISA TAKIZAWA, ET AL.

It is certified that error appears in the above-identified patent and that said Letters Patent is hereby corrected as shown below:

COLUMN 7

Line 5, "Then" should read --Then,--.
Line 31, "$d^2Vd/dt^20$," should read --$d^2Vd/dt^2 \leq 0$,--.

COLUMN 10

Line 13, "2,5hex-" should read --2,5-hex- --.

COLUMN 11

Line 42, "viscosity $\gamma$" should read --viscosity $\eta$--.

COLUMN 16

Line 5, "m/sec" should read --m/sec,--.
Line 20, "tension," should read --tension $\gamma$,--.
Line 23, "tension," should read --tension $\gamma$,--.

Signed and Sealed this

Seventh Day of October, 1997

*Attest:*

*Attesting Officer*

BRUCE LEHMAN

*Commissioner of Patents and Trademarks*